United States Patent [19]

Fenton, Jr. et al.

[11] 4,405,050

[45] Sep. 20, 1983

[54] QUICK ROLL ADJUSTMENT FOR A ROLLER SCREEN CONVEYOR

[75] Inventors: Edward A. Fenton, Jr., Pittsburgh; John F. Simpson, Jr., Eighty Four, both of Pa.

[73] Assignee: Dravo Corporation, Pittsburgh, Pa.

[21] Appl. No.: 330,460

[22] Filed: Dec. 14, 1981

[51] Int. Cl.[3] ..... B07B 1/14

[52] U.S. Cl. ..... 209/668; 209/394; 209/673; 198/782

[58] Field of Search ..... 209/659, 660, 667, 668, 209/673, 393, 394; 198/782; 308/208, 209

[56] References Cited

U.S. PATENT DOCUMENTS

| | | | |
|---|---|---|---|
| 282,719 | 8/1883 | Gunckel | 209/668 |
| 483,225 | 9/1892 | Lampitt | 209/668 |
| 1,325,505 | 12/1919 | Bong | 209/394 |
| 1,484,025 | 2/1924 | Hofer | 209/394 X |
| 1,711,740 | 5/1929 | McCann | 198/782 |
| 2,365,822 | 12/1944 | Jones | 209/668 |
| 2,370,539 | 2/1945 | Hodecker | 209/668 |
| 2,786,574 | 3/1957 | Clark | 209/668 |
| 3,108,691 | 10/1963 | Vance | 209/668 |
| 3,367,494 | 2/1968 | Peterson | 209/668 |
| 3,770,123 | 11/1973 | Mraz | 209/668 |
| 3,848,741 | 11/1974 | Haley et al. | 209/668 |
| 4,148,398 | 4/1979 | Mustikka | 209/673 X |
| 4,209,097 | 6/1980 | Nordmark et al. | 209/673 X |
| 4,291,808 | 9/1981 | Roloff | 209/668 |
| 4,311,242 | 1/1982 | Hnatko | 209/668 |

FOREIGN PATENT DOCUMENTS

| | | | |
|---|---|---|---|
| 660951 | 4/1963 | Canada | 198/782 |
| 15905 | of 1886 | United Kingdom | 209/667 |

*Primary Examiner*—Bruce H. Stoner, Jr.
*Assistant Examiner*—Edward M. Wacyra
*Attorney, Agent, or Firm*—Parmelee, Miller, Welsh & Kratz

[57] ABSTRACT

A roller adjustment apparatus provides for the independent adjustment of spacing between any two adjacent rigidly spaced apart rollers without affecting the spacing of any of the other rollers in a roller screen conveyor. A support block of the apparatus, which rotatably supports an end of the roller and is slidably mounted on the conveyor frame, has two oppositely extending threaded bores oriented normal to the axis of rotation of the roller and parallel to the longitudinal axis of the conveyor. A threaded adjusting bolt, having oppositely threaded ends, is placed intermediate adjacent support blocks and engages the confronting threaded bores therein such that rotation of the adjusting bolt either increases or decreases the spacing between adjacent rollers. Threaded studs and a threaded adjusting sleeve are alternate corresponding forms for adjusting the roller spacing. In one embodiment a support block having grooves along its top and bottom surfaces is slidably mounted between two support rails which are attached to the conveyor frame and engage the grooves. During spacing adjustment, the rails allow the other rollers attached to the opposite sides of the rollers undergoing adjustment to be either pushed or pulled thereon without affecting the spacing between any of these other rollers.

21 Claims, 6 Drawing Figures

QUICK ROLL ADJUSTMENT FOR A ROLLER SCREEN CONVEYOR

FIELD OF INVENTION

The apparatus described herein permits independent adjustment of the spacing between any two adjacent rollers of a roller screen conveyor used to classify particulate material by size without affecting the spacing between any of the other rollers in the conveyor screen.

BACKGROUND OF THE INVENTION

Roller screen conveyors having a plurality of spaced apart rollers are typically used to size or grade material being conveyed by and over the rollers. By changing the amount of spacing between adjacent rollers, oversized material, undersized material or both may be separated from the desired material size. Various materials may be graded by a conveyor screen; green iron ore pellets being a prime example. Typically, the rollers closest to the feed end of the conveyor are spaced so that undersized material will drop through the space therebetween. The remaining rollers are spaced for the desired material size. The oversized material, unable to fall between the rollers, is discharged off the end of the conveyor screen.

In order to be able to change the sizing of the material desired or to correct for wearing of the surface of the rollers, the spacing between the rollers must be adjustable. Various techniques have been developed to accomplish this adjustment. One approach requires that each roller is individually adjustable; a second approach utilizes simultaneous adjustment of spacing for a group of rollers. U.S. Pat. No. 3,848,741 is an example of this first approach while U.S. Pat. Nos. 483,225, 1,325,505, 2,365,822 and 3,367,494 are examples of the second. A variation of the second approach allows for the simultaneous and unequal adjustment of the rollers. Pivoting linkages, nonlinear or multiple pitch screws are some of the means used to accomplish this result. Examples of this variation are given in U.S. Pat. Nos. 1,484,025, 4,148,398 and 4,209,097. While these patents all illustrate adjusting devices for changing the spacing of rollers on a roller screen conveyor, these devices do not possess the capability of permitting any adjustment in the spacing between any two adjacent rollers without affecting the spacing between any of the other remaining rollers.

SUMMARY OF THE INVENTION

The adjustment apparatus of this invention comprises a support block, an adjusting means and an adjustment engaging means. The support block, which is slidably mounted on the frame of the conveyor and is moveable in a direction parallel to the longitudinal axis thereof, rotatably supports the ends of each roller, preferably using self-aligning journal bearings mounted in or on the support block. Two oppositely extending adjustment engaging means are positioned on the support block and are oriented normal to the axis of rotation of the roller. Independent adjusting means are placed intermediate adjacent support blocks and engage the confronting adjustment engaging means of these adjacent support blocks. Operation of the adjusting means increases or decreases the spacing between adjacent rollers without changing the spacing between any of the other rollers of the roller screen conveyor.

The adjustment apparatus as described herein is preferably provided on each end of the roller; however, this is not absolutely necessary. The only requirements are that the location of at least one end of each roller be fixed by the adjustment apparatus and that both ends of the roller be free to move during spacing adjustment along a line substantially parallel to the longitudinal axis of the conveyor. Where only one end of the roller is positioned by the adjustment apparatus, the opposite end may be slidably supported on a rail or channel and locked in place after the desired spacing between adjacent rollers is reached. Both ends of the roller must be fixed in place so that during operation of the conveyor the spacing between rollers does not change. When the adjustment apparatus is used on only one end of each roller, preferably it is on the same end of each of the rollers.

The support block has two adjustment engaging means extending in opposite directions along a line normal to the axis of rotation of the roller and parallel to the longitudinal axis of the conveyor. An independent adjusting means is placed intermediate adjacent support blocks and engages the confronting adjustment means thereof to form a structure of alternating support blocks and adjustment means. With this arrangement, extension or retraction of the adjusting means in a line substantially parallel to the longitudinal axis of the conveyor moves the adjacent support blocks farther apart or closer together. Because the other slidably mounted support blocks are similarly connected to the other adjustment engaging means of the support blocks undergoing adjustment, these other support blocks will slide along the conveyor while maintaining their rigidly fixed spacing.

Various forms of adjusting means and adjustment engaging means are possible. In the preferred embodiments, the adjusting means is rotatable with the adjustment engaging means being adapted to rotatably engage therewith. One form of a rotatable adjusting means is a rod having a threaded portion at each end, the threaded portions having opposite threads. Accordingly, the adjustment engaging means used here is a threaded bore. Confronting bores of adjacent support blocks have opposite threads so that rotation of the adjusting means in one direction moves adjacent support blocks closer toward each other and rotation in the opposite direction moves adjacent support blocks farther apart. The threads of each of the two threaded bores in a support block may either be the same or opposite, so long as confronting bores of adjacent support blocks have opposite threads.

Another form of the rotatable adjusting means is a cylindrical sleeve having oppositely threaded bores at each end. In this arrangement, each support block has two threaded face rods or studs oppositely extending therefrom in a direction normal to the axis of the roller and parallel to the longitudinal axis of the conveyor for threadably engaging the adjusting sleeve. Again, the confronting threaded face rods of adjacent support blocks must have opposite threads so that rotation of the adjusting sleeve in one direction moves adjacent support blocks closer toward each other and rotation in the opposite direction moves adjacent support blocks further apart. The threads of each of the face rods or studs of a support block may either be the same or opposite provided that confronting face rods of adjacent support blocks are oppositely threaded.

The slidable mounting of the support block may also have various configurations. In one configuration the support block is provided with a first groove along the top and a second groove substantially prallel to the first groove along the bottom. Both grooves are oriented in a direction parallel to the longitudinal axis of the conveyor. These grooves slidably engage correspondingly shaped support rails mounted on the roller screen conveyor. This groove-rail arrangement permits the support block to slide between the rails during the adjustment of their spacing. A second mounting arrangement involves the use of L-shaped notches along the top and bottom of the support blocks in conjunction with a shield plate having sufficient size to longitudinally bridge the opening between adjacent support blocks when such blocks are at any point between their minimum and maximum spacing. The shield plate is connected to the support block such that an essentially U-shaped channel is formed at the top and bottom of the support block by the shield plate and notches. The shield plate extends in one direction, parallel to the longitudinal axis of the conveyor, overlaps the adjacent support block and is in slidable engagement thereon. This mounting of the shield plate prevents material from entering the chain enclosure and contaminating the chain lubricant.

DETAILED DESCRIPTION

Figure 1:
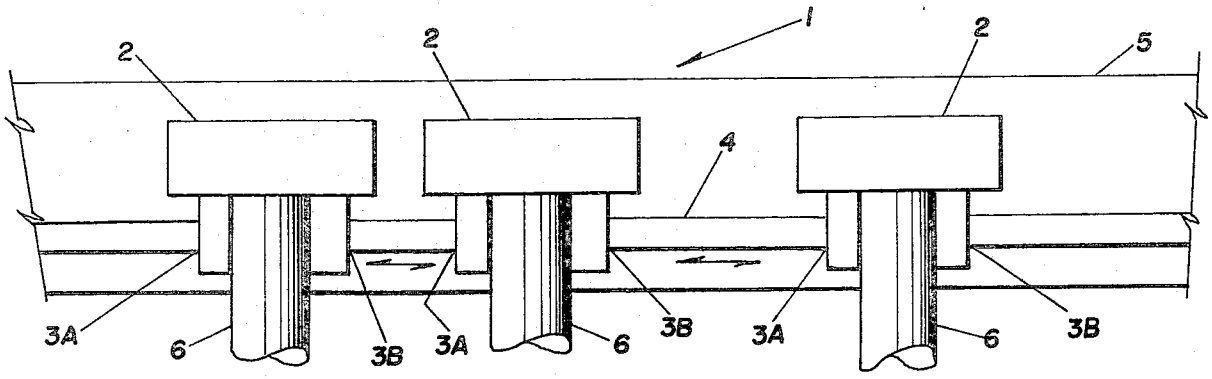
FIGS. 1 and 2 are schematic plan and elevational views, respectively, of adjustment apparatus made in accordance with the invention.
Figure 2:
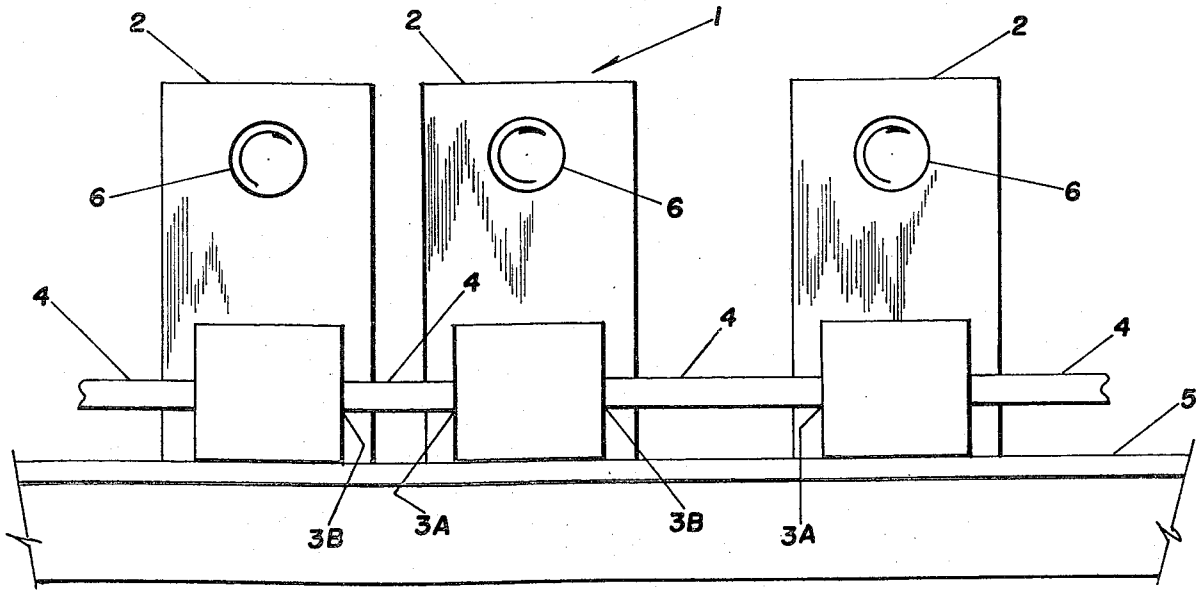

An adjustment apparatus 1, comprised of a plurality of support blocks 2, each having two adjustment engaging means 3A, 3B and a plurality of adjusting means 4 is shown in FIGS. 1 and 2. Each support block 2 is slidably mounted on the frame 5 of the conveyor and is moveable in a direction parallel to the longitudinal axis thereof as indicated by the double headed arrows shown in FIG. 1. Each support block 2 rotatably supports an end of a roller 6. Preferably, both ends of the rollers are supported by the adjustment apparatus 1. The adjustment engaging means 3A, 3B oppositely extend along a line normal to the axis of rotation of the roller 6 and parallel to the longitudinal axis of the conveyor. The adjusting means 4 are positioned intermediate confronting adjustment engaging means 3B, 3A of adjacent support blocks 2 and engage the adjustment engaging means to form a structure of alternating support blocks 2 and adjusting means 4 which rigidly fixes the spacing between adjacent rollers 6. Extension of the adjusting means 4 in a line substantially parallel to the longitudinal axis of the conveyor increases the spacing between adjacent support blocks 2 while retraction of the adjusting means 4 decreases this spacing. The spacing adjustment does not effect the rigidly fixed spacing between the other rollers which are similarly mounted and connected to the other adjustment engaging means of the support blocks 2 undergoing adjustment. These rollers are either pushed or pulled along the frame 5 of the conveyor depending upon the direction of change in the spacing of the adjacent rollers undergoing adjustment.

The support blocks 2 of FIGS. 1 and 2 are shown illustrating the differences in spacing possible between adjacent support blocks 2. The minimum spacing occurs when the support blocks 2 were in contact. The maximum spacing is determined by the length of the adjusting means 4 provided. Unequal lengths for these means may be used as where larger or smaller diameter rollers are used along a portion of the roller screen conveyor.

Figures 3, 4:
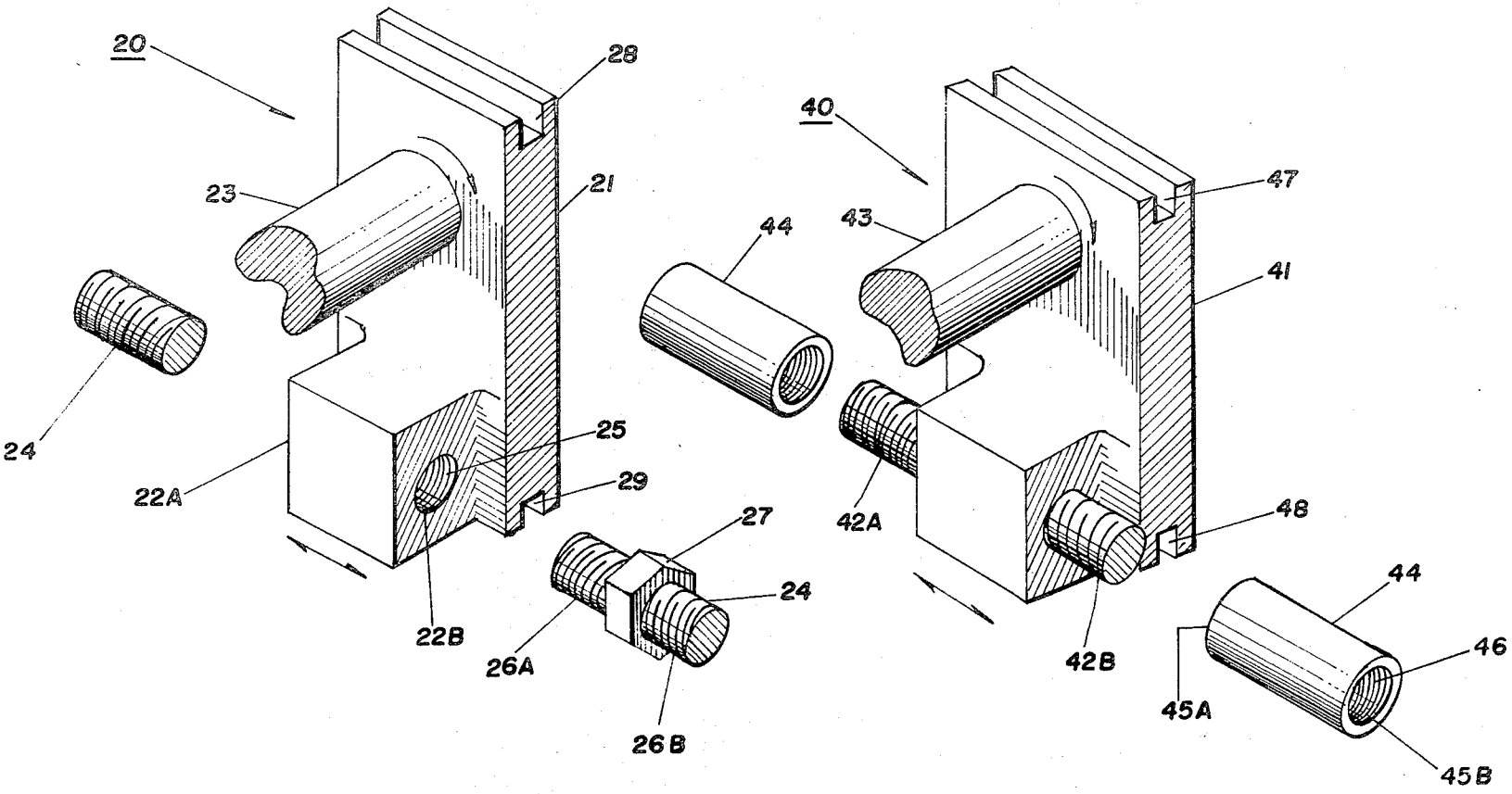
FIG. 3 is an exploded isometric view of one embodiment of the invention utilizing threaded adjusting rods.
FIG. 4 is an exploded isometric view of another alternate embodiment of the invention utilizing threaded adjusting sleeves.

FIGS. 3 and 4 illustrate two forms of the engagement adjusting means and the adjusting means. In FIG. 3 the adjustment apparatus 20 comprises a support block 21 having two threaded bores 22A, 22B, oppositely extending along a line normal to the axis of rotation of the roller 23, and parallel to the longitudinal axis of the conveyor for threadably engaging a threaded adjusting bolt or rod 24. The bores 22A, 22B may either be two separate bores or may be one continuous bore. The threads 25 of the two bores 22A, 22B may either be the same, i.e. both right handed or both left handed, or they may be opposite, the only requirement for thread direction being that confronting bores of adjacent support blocks have opposite threads. The end portions 26A, 26B of each adjusting bolt 24 are threaded with opposite threads. This rod may also be provided with a hexagonal collar 27 to allow for rotation by an open-end wrench or similar tool. Also shown on the support block 21 is a first groove 28 located along the top thereof and a second groove 29, located along the bottom thereof, both grooves being positioned along a line parallel to the longitudinal axis of the conveyor. Each groove slidably engages a correspondingly shaped support rail mounted on the frame of the conveyor so that the support blocks 21 slide therebetween during adjustment of the spacing between the rollers 23 (See FIGS. 5 and 6). The operation of the apparatus 20 is the same as that previously described hereinabove except that the adjusting rod 24 is rotated in order to adjust the spacing between adjacent rollers.

In FIG. 4 the adjustment apparatus 40 comprises a support block 41 having two threaded face rods or studs 42A, 42B, oppositely extending along a line normal to the axis of rotation of the roller 43, and parallel to the longitudinal axis of the conveyor for threadably engaging a hollow cylindrical adjusting sleeve 44. The face rods are positioned and threaded as set forth in the description of the threaded bores 22A, 22B. Each end of the sleeve 44 defines a bore 45A, 45B having internal threads 46, with the threads 46 in each end 45A, 45B being opposite. As with the bores 22A and 22B, the bores 45A and 45B are either two separate bores or one continuous bore. Also grooves 47, 48 may be provided as previously described. By rotating the adjusting sleeve 44 the spacing of adjacent rollers may be changed. A hexagonal collar or openings (not shown) may also be provided on or in the adjusting sleeve 44 to permit ease of rotation.

Figure 5:
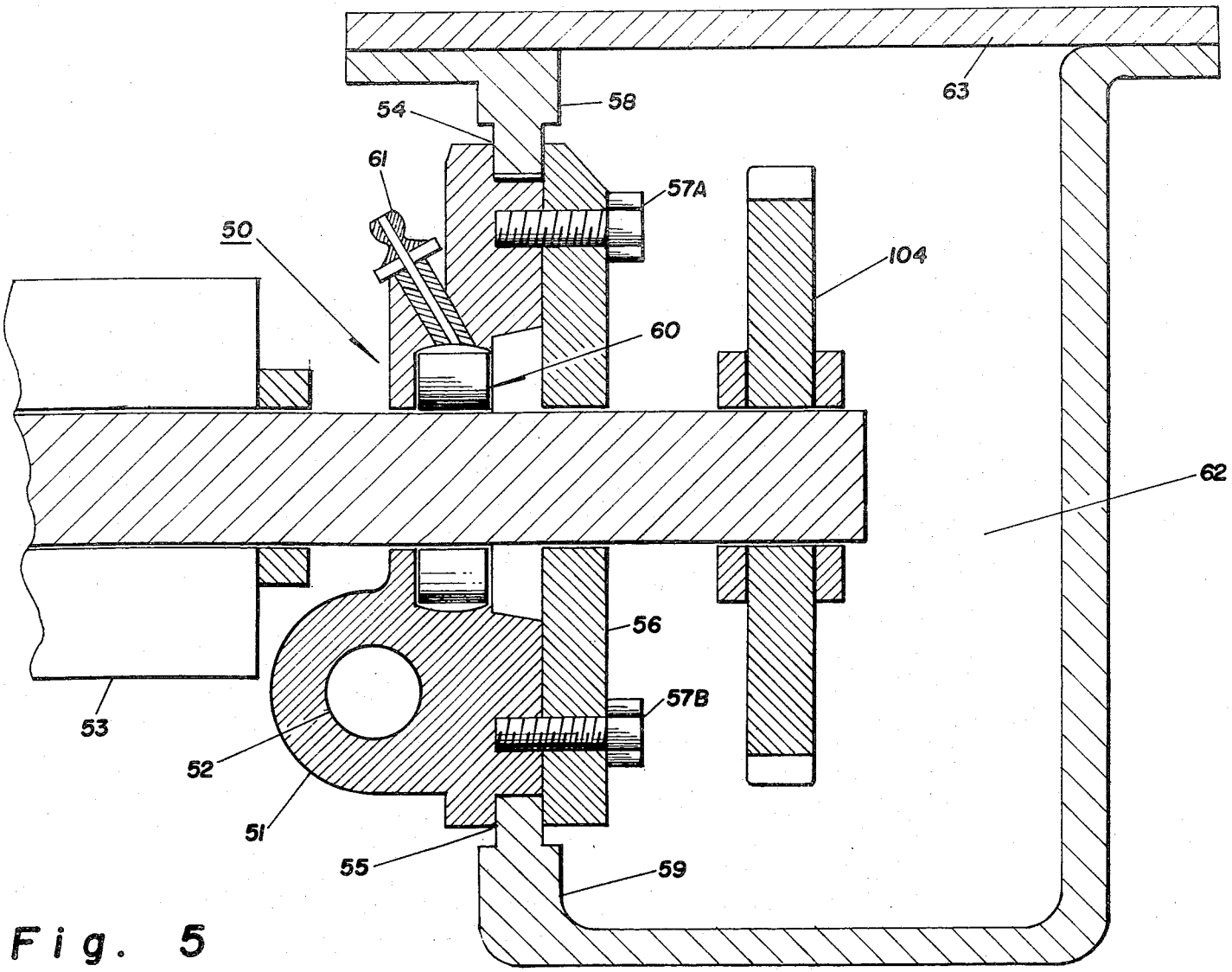
FIG. 5 is a sectional drawing of another alternate embodiment of the invention illustrating the shield plate and support rails.
Figure 6:
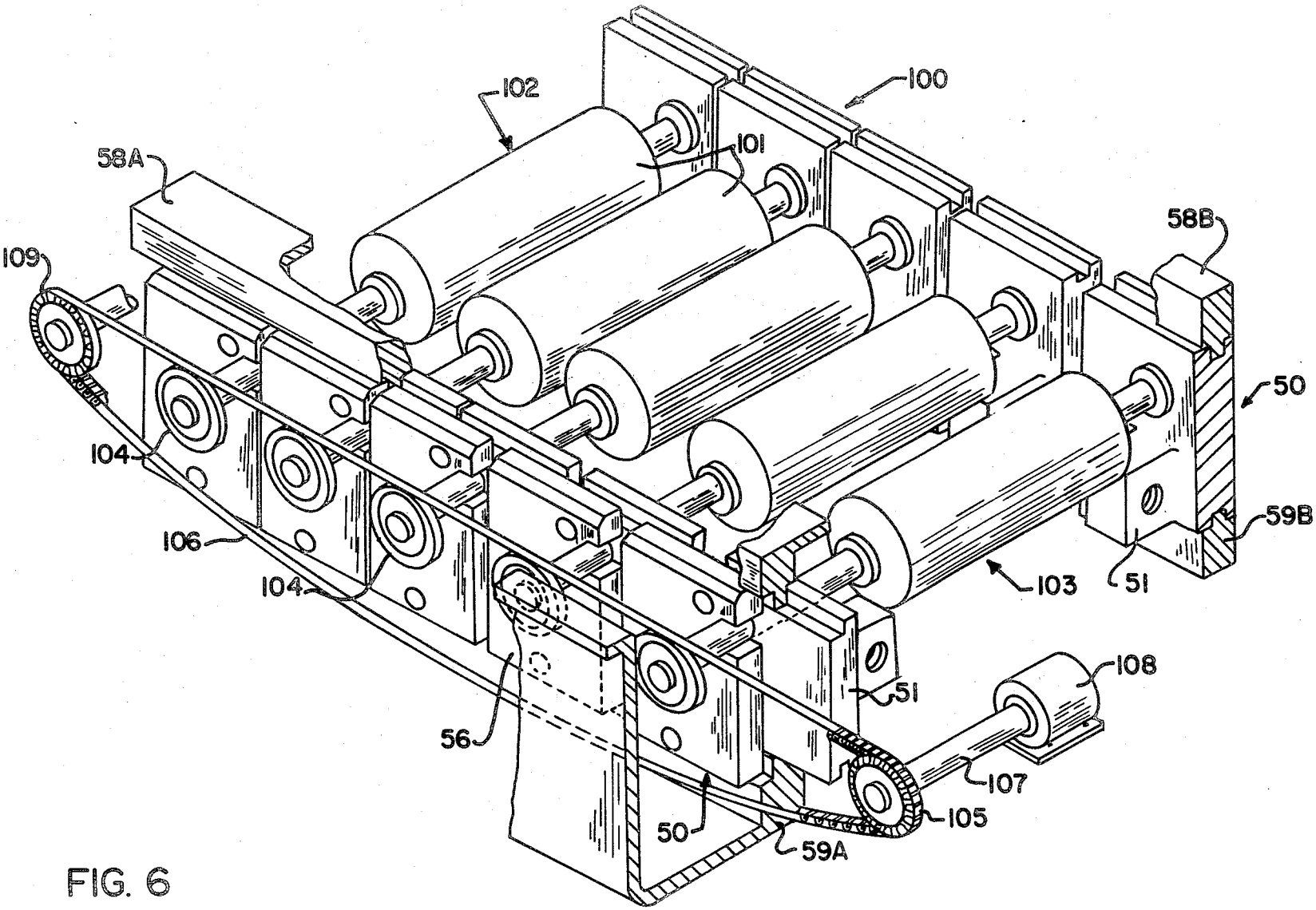
FIG. 6 is an isometric view of a roller screen conveyor utilizing the adjustment apparatus shown in FIG. 5.

FIG. 5 presents a cross-sectional view of an adjusting means utilized on the roller screen conveyor shown in FIG. 6. The adjustment apparatus 50 is comprised of a support block 51 having two threaded bores 52 (only one shown) oriented normal to the axis of rotation of the roller 53 and parallel to the longitudinal axis of the conveyor for threadably engaging the adjusting means. The block 51 rotatably supports the end of the roller 53 in bearing 60. In addition, a first L-shaped notch 54 is provided along the top of the support block 51 and a second L-shaped notch 55, is provided along the bottom of the support block 51. Both notches are positioned along a line substantially parallel to the longitudinal axis of the conveyor. A shield plate 56 is connected to the support block 51 by connecting means 57A, 57B such that an essentially U-shaped channel is formed by the notches 54, 55 and the shield plate 56. Support rails 58 and 59, mounted on the conveyor frame above and below the support blocks, slidably engage the U-shaped channels to permit the support blocks to slide therebetween during the adjustment of spacing. The shield plate 56 and support block 51, when connected, form a sealed lubrication chamber 62 with 58, 59 and 63 about the end of the roller 53 which is being rotatably supported by the block 51. A lubrication means 61, mounted on the block 51 is used to lubricate bearing 60. The shield plate 56 extends in one direction parallel to the longitudinal axis of the conveyor, overlaps the adjacent support block 51 and is in slidable engagement thereon. (See FIG. 6). This arrangement of the shield plate 51 helps to keep material or other debris from contaminating the chain lubricant located in the chain enclosure 62. The size of the shield plate 56 is determined by the maximum desired spacing. The operation of the adjusting apparatus 50 is the same as previously described hereinabove. The shield plate 56 can also have an opening (not shown) through which the end of roller 53 can extend permitting a sprocket to mount thereon (See FIG. 6).

A roller screen conveyor 100 utilizing the adjusting apparatus 50 is shown in FIG. 6. The conveyor 100 includes a plurality of spaced driven rollers 101 (only 5 shown) for the sizing of material being conveyed thereon with the sizing determined by the spacing between adjacent rollers. Typically, the rollers nearest the feed end 102 of the conveyor are spaced to permit undersized material to fall through the conveyor at this point. The remaining rollers are spaced for the desired material size while the oversize material is conveyed off the discharge end 103 of the conveyor 100. The three classifications of the material are separately collected in bins or conveyors (not shown) below the rollers. Each roller has a sprocket 104 mounted near one end thereof. The sprockets of all the rollers are substantially aligned with a drive sprocket 105. A drive chain 106 forms a continuous loop which engages each roller sprocket 104, the drive sprocket 105 and an idler sprocket 109. A drive means 108, such as an electric motor-gear reducer combination is connected to the drive sprocket 105 by a drive shaft 107. Rotation of the drive chain 106 by the motor 108 through drive sprocket 105 causes rotation of the roller sprockets 104, which in turn drive the rollers 101. Preferably, each end of each roller is supported by the adjustment apparatus 50 but only one end of each roller need be driven. The support blocks 51 are slidably mounted between the support rails 58A, 58B, 59A and 59B which are located along each end of the rollers 101 and positioned in a line normal to the axis of rotation of the roller. Typically, the support blocks 51 for an end roller are fixed to the support rails to prevent them from sliding. Fixing a roller in place allows this roller to absorb the thrust of the remaining rollers. Preferably, the end roller adjacent the drive sprocket 105 is fixed in this manner.

We claim:

1. In a roller screen conveyor hving a frame with a plurality of spaced parallel rollers mounted thereon, each with its longitudinal axis normal to the longitudinal axis of the conveyor, an apparatus for adjusting and rigidly fixing the spacing between adjacent rollers comprising:

a plurality of roller support blocks slidably mounted on the frame of the conveyor and movable in a direction parallel to the longitudinal axis thereof, each roller support block rotatably supporting an end of a roller and having two adjustment engaging means oppositely extending normal to the axis of rotation of the roller and parallel to the longitudinal axis of the roller screen conveyor; and a plurality of independent adjusting means for independently and rigidly fixing the spacing between adjacent support blocks, each adjusting means positioned intermediate confronting adjustment engaging means of adjacent support blocks and engaging the adjustment engagement means to form a structure of alternating support blocks and adjustment means, such that extension of the adjustment means in a line sustantially parallel to the longitudinal axis of the conveyor moves the adjacent support blocks farther apart while retraction of the adjustment means along a line substantially parallel to the longitudinal axis of the conveyor moves the adjacent blocks closer together without affecting the spacing between the other slidably mounted support block similarly connected to the other adjustment engaging means of the support blocks being adjusted.

2. The apparatus as described in claim 1 wherein the adjusting means includes a rotatable adjusting means.

3. The apparatus as described in claim 2 wherein the adjustment engaging means further comprises a support block having a bore for receiving the rotatable adjusting means.

4. The apparatus as described in claim 2 wherein the rotatable adjusting means includes a rod having a threaded portion at each end, the threaded portions having opposite threads.

5. The apparatus as described in claim 4 wherein the adjustment engaging means further comprises the support block having two threaded bores oppositely extending along a line normal to the axis of rotation of the roller and parallel to the longitudinal axis of the roller screen conveyor, the threaded bores threadably engaging the threaded adjusting rod, the threaded confronting bores of adjacent support blocks having opposite threads to that rotation of the adjusting means in one direction moves adjacent support blocks closer toward each other and rotation in the opposite direction moves adjacent support blocks further apart.

6. The apparatus as described in claim 5 wherein the threads of each threaded bore in each support block are the same.

7. The apparatus as described in claim 5 wherein the threads of each threaded bore in each support block are opposite.

8. The apparatus as described in claim 4 wherein the support block has a single threaded bore therethrough extending along a line normal to the axis of rotation of the roller and parallel to the longitudinal axis of the conveyor for threadably engaging a threaded adjusting rod at each end thereof.

9. The apparatus as described in claim 8 wherein the threads at each end of the bore are the same.

10. The apparatus as described in claim 8 wherein the threads at each end of the bore are opposite.

11. The apparatus as described in claim 2 wherein the rotatable adjusting means includes a cylindrical sleeve having a bore at each end, the bores having oppositely threaded internal threads.

12. The apparatus as described in claim 11 wherein the adjustment engaging means further comprises each support block having two threaded face rods oppositely extending therefrom in a direction normal to the axis of rotation of the roller and parallel to the longitudinal axis of the conveyor for threadably engaging the threaded sleeve, the confronting threaded face rods of adjacent support blocks having opposite threads so that rotation of the adjusting sleeve in one direction moves adjacent support blocks closer toward each other and rotation in the opposite direction moves adjacent support blocks farther apart.

13. The apparatus as described in claim 12 wherein the threads of each of the face rods on each support block are the same.

14. The apparatus as described in claim 12 wherein the threads of each of the face rods on each support block are opposite.

15. The apparatus as described in claim 2 wherein the support block further comprises a support block having a first groove along the top and a second groove along the bottom thereof, both grooves positioned in a direction parallel to the longitudinal axis of the conveyor, each groove slidably engaging a correspondingly shaped support rail mounted on the conveyor so that the support blocks slide therebetween during adjustment of spacing.

16. The apparatus of claim 1 including a shield plate of sufficient size to bridge the opening between adjacent support blocks when the adjacent support blocks are positioned at any point between their maximum and minimum spacing, and means for connecting the shield plate to a support block with said shield plate extending in a direction parallel to the longitudinal axis of the roller screen conveyor and overlapping the adjacent support block and being in slidable engagement therewith for all positions of said adjacent support blocks.

17. The apparatus as described in claim 1 wherein the support block further comprises:

a support block having a first L-shaped notch along the top and a second L-shaped notch along the bottom thereof, both notches positioned in a direction parallel to the longitudinal axis of the conveyor, each notch slidably engaging a correspondingly shaped support rail mounted on the conveyor so that the support blocks slide therebetween during adjustment of roller spacing;

a shield plate of sufficient size to bridge the opening between adjacent support blocks when the adjacent support blocks are positioned at any point between their minimum and maximum spacing locations; and a means for connecting the shield plate to the support block such that an essentially U-shaped channel is formed at the top and bottom of the support block by the shield plate and notches, said shield plate extending in one direction parallel to the longitudinal axis of the roller screen conveyor overlapping the adjacent support block and being in slidable engagement thereon so that adjacent support blocks are slidably positionable with respect to each other.

18. The apparatus as described in claim 17 wherein a support block, two adjustment engaging means and support rails are provided for each end of the roller.

19. In an apparatus having a frame with a plurality of spaced parallel rollers thereon, the rollers being positioned normal to the longitudinal axis of the conveyor, an apparatus for adjusting and rigidly fixing the spacing between adjacent rollers comprising:

a plurality of roller support blocks slidably mounted on a frame of the conveyor and movable in a direction parallel to a longitudinal axis thereof, each roller support block rotatably supporting an end of the roller and having two oppositely extending threaded bores therein, the bores being positioned along a line normal to the axis of rotation of the roller and parallel to the longitudinal axis of the roller screen conveyor, the support block having a first L-shaped notch along the top and a second L-shaped notch along the bottom, both notches positioned in a line parallel to the longitudinal axis of the conveyor;

a shield plate of sufficient size to bridge the opening between adjacent support blocks when the adjacent support blocks are positioned at any point between their minimum and maximum spacing locations;

a means for connecting the shield plate to the support block such that an essentially U-shaped channel is formed at the top and bottom thereof by the shield plate and notches, the shield plate extending in one direction parallel to the longitudinal axis of the roller screen conveyor overlapping the adjacent support block and being in slidable engagement thereon;

a top support rail and a bottom support rail mounted on the conveyor along a line substantially parallel to the longitudinal axis of the conveyor, each rail having an edge shaped to slidably engage the U-shaped channels of the support block such that the support blocks can slide therebetween during adjustment of spacing; and a plurality of threaded adjusting bolts, each bolt positioned intermediate adjacent support blocks and being threadably engaged with the confronting threaded bores of adjacent support blocks forming a structure of alternating support blocks and adjusting bolts, the confronting bores of adjacent support blocks having opposite threads such that rotation of the bolt in one direction moves the adjacent support blocks connected thereto closer toward each other and rotation in the opposite direction moves the blocks further apart without affecting the spacing between the other slidably mounted support blocks similarly connected to the opposite bores of the support blocks being adjusted.

20. A roller screen conveyor having a plurality of spaced driven rollers mounted on the frame thereof for sizing of material being conveyed thereon with the sizing determined by the spacing between adjacent rollers through which the material will fall, each roller having a sprocket mounted on one end thereof, the roller sprockets being substantially in line with and between a drive sprocket and an idler sprocket rotatably mounted on the frame, a drive chain mounted on the idler and driving sprockets so as to form a loop, the drive chain engaging each roller sprocket so that turning of the drive sprocket by a drive means causes the drive chain to rotate each roller sprocket turning the rollers wherein the improvement comprises:

a plurality of roller support blocks slidably mounted on the frame and moveable in a direction parallel to a longitudinal axis of the conveyor, each end of each roller being rotatably supported by a support block having two oppositely extending threaded bores therein, the bores being positioned along a line normal to the axis of rotation of the roller and parallel to the longitudinal axis of the roller screen conveyor, the support block having a first L-shaped notch along the top and a second L-shaped notch along the bottom, both notches positioned in a line parallel to the longitudinal axis of the conveyor;

a shield plate of sufficient size to bridge the opening between adjacent support blocks when the adjacent support blocks are positioned at any point between their minimum and maximum spacing locations;

a means for connecting the shield plate to the support block such that an essentially U-shaped channel is formed at the top and bottom of the support block by the shield plate and notches, said shield plate extending in one direction parallel to the longitudinal axis of the roller screen conveyor overlapping the adjacent support block and being in slidable engagement thereon so that adjacent support blocks are slidably positionable with respect to each other;

a top support rail and a bottom support rail mounted on the conveyor along a line substantially parallel to the longitudinal axis of the conveyor, each rail having an edge shaped to slidably engage the U-shaped channels of the support block such that the support blocks can slide therebetween during adjustment of spacing; and a plurality of threaded adjusting bolts, each bolt positioned intermediate adjacent support blocks and being threadably engaged with the confronting threaded bores of adjacent support blocks forming a structure of alternating support blocks and adjusting bolts, the confronting bores of adjacent support blocks having opposite threads such that rotation of the bolt in one direction moves the adjacent support blocks connected thereto closer toward each other and rotation in the opposite direction moves the blocks further apart without affecting the spacing between the other slidably mounted support blocks similarly connected to the opposite bores of the support blocks being adjusted; and one end roller having the support blocks fixed to the rails to prevent the movement of the roller along the rails so that it can absorb the thrust of the remaining rollers connected thereto by the adjusting bolts with the remaining rollers being slidable along the support rails.

21. The roller screen conveyor as described in claim 20 including a lubrication chamber formed by the support block, shield plate, and frame about the sprocket on the end of the roller, which chamber may be filled with lubricant for the drive chain.

* * * * *